US008111213B2

(12) United States Patent
Kim et al.

(10) Patent No.: US 8,111,213 B2
(45) Date of Patent: Feb. 7, 2012

(54) PLASMA DISPLAY DEVICE AND DRIVING METHOD THEREOF

(75) Inventors: Jeongmo Kim, Yongin-si (KR); Chanyoung Han, Yongin-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 1008 days.

(21) Appl. No.: 12/073,389

(22) Filed: Mar. 5, 2008

(65) Prior Publication Data

US 2008/0218445 A1 Sep. 11, 2008

(30) Foreign Application Priority Data

Mar. 6, 2007 (KR) ..... 10-2007-0021765

(51) Int. Cl.
*G09G 3/28* (2006.01)

(52) U.S. Cl. ..... 345/60

(58) Field of Classification Search ..... 345/60–63; 315/169.4

See application file for complete search history.

(56) References Cited

U.S. PATENT DOCUMENTS

| | | | | |
|---|---|---|---|---|
| 2004/0012547 | A1* | 1/2004 | Lee | 345/60 |
| 2005/0168406 | A1* | 8/2005 | Lee et al. | 345/60 |
| 2005/0190120 | A1 | 9/2005 | Yoo | |
| 2007/0080902 | A1* | 4/2007 | Kim et al. | 345/67 |
| 2007/0109222 | A1* | 5/2007 | Yoon | 345/63 |
| 2007/0222706 | A1 | 9/2007 | Tachibana et al. | |

FOREIGN PATENT DOCUMENTS

| | | |
|---|---|---|
| JP | 2001-272949 | 10/2001 |
| JP | 2005-249949 | 9/2005 |
| KR | 10 2001-0035881 A | 5/2001 |
| KR | 10-2005-0051043 A | 6/2005 |
| KR | 10 2005-0087327 A | 8/2005 |
| KR | 10-2006-0007688 A | 1/2006 |
| KR | 10 2006-0041594 A | 5/2006 |

* cited by examiner

*Primary Examiner* — Chanh Nguyen
*Assistant Examiner* — Tsegaye Seyoum
(74) *Attorney, Agent, or Firm* — Lee & Morse, P.C.

(57) ABSTRACT

A driving method of a plasma display device including a plurality of first electrodes divided into a plurality of groups including first and second groups, a plurality of second electrodes, and a plurality of third electrodes that intersect the plurality of first and second electrodes, may include dividing one frame into a plurality of subfields, each subfield including a reset period, an address period and a sustain period so as to be driven by a time division method, supplying a scan pulse and a scan reference voltage to the first group during a first address period in the address period, supplying a compensation pulse to at least one of the first and second groups during an address compensation period in the address period, and supplying the scan pulse and the scan reference voltage to the second group during a second address period in the address period.

4 Claims, 6 Drawing Sheets

PLASMA DISPLAY DEVICE AND DRIVING METHOD THEREOF

BACKGROUND OF THE INVENTION

1. Field of the Invention

Embodiments of the present invention relate to a plasma display device and a driving method thereof. More specifically, embodiments of the present invention relate to a plasma display device that may compensate for wall charge decay during an address period.

2. Description of the Related Art

Generally, a plasma display device uses an ADS (Address and Display period Separated) driving method, in which one frame is divided into a plurality of subfields. Each subfield typically includes a reset period, an address period, and a sustain period.

During the reset period, wall charges formed in a prior period are relocated to perform an address discharge stably. During the address period, wall charges for sustain discharge are generated by the address discharge occurring in discharge cells to be turned on. Generally, during the address period, a bias pulse is supplied to sustain electrodes, a scan pulse is sequentially to the scan electrodes, and an address pulse is supplied to the address electrodes to perform address discharge in discharge cells to be turned on, thereby generating wall charges for use in the sustain period.

During the sustain period, an image is displayed on the plasma display panel using the wall charges generated in the address period.

As the number of scan electrodes in the plasma display device increases, time between completion of the reset period to the supply of the scan pulse to later scan electrodes increases. Accordingly, wall charges may decay during the address period, which may result in erroneous address discharge and/or sustain discharge.

SUMMARY OF THE INVENTION

Embodiments of the present invention are therefore directed to a plasma display device and a driving method thereof, which substantially overcome one or more of the problems and disadvantages of the related art.

It is a feature of an embodiment to provide a plasma display device and a driving method thereof to maintain adequate wall charges during the address period across a plurality of scan electrode groups to reduce or prevent address discharge from occurring at a low discharge.

It is another feature of an embodiment to provide a plasma display device and a driving method thereof to maintain adequate wall charges realized in the address period across a plurality of scan electrode groups for use in the sustain period.

It is yet another feature of an embodiment to provide a plasma display device and a driving method thereof to supply driving waveforms to each group in a plurality of scan electrode groups using the same driving circuit.

At least one of the above and other features and advantages may be realized by providing a driving method of a plasma display device including a plurality of first electrodes divided into a plurality of groups including first and second groups, a plurality of second electrodes, and a plurality of third electrodes that intersect the plurality of first and second electrodes, the method including dividing one frame into a plurality of subfields, each subfield including a reset period, an address period and a sustain period so as to be driven by a time division method, supplying a scan pulse and a scan reference voltage to the first group during a first address period in the address period, supplying a compensation pulse to at least one of the first and second groups during an address compensation period in the address period, and supplying the scan pulse and the scan reference voltage to the second group during a second address period in the address period.

Supplying the compensation pulse may include supplying first and second compensation pulses to the first and second groups, respectively. The first compensation pulse may have a first voltage higher than the scan reference voltage, and the second compensation pulse may have a second voltage higher than the scan reference voltage. The scan pulse may have a third voltage lower than the scan reference voltage.

The first compensation pulse may have a fifth voltage that gradually increases from the first voltage up to a sum of the first voltage and a fourth voltage.

The second compensation pulse may have a sixth voltage that gradually increases from the second voltage up to a sum of the second voltage and the fourth voltage.

The first and second compensation pulses may be simultaneously or sequentially supplied to the first and second groups, respectively.

A voltage level of the first compensation pulse supplied to the first group may be sequentially lowered. A voltage level of the second compensation pulse supplied to the first group may be sequentially raised.

The first compensation pulse may have a voltage sufficient to maintain wall charges in the first group during the second address period. The second compensation pulse may have a voltage sufficient to restore wall charges in the second group after the first address period.

At least one of the above and other features and advantages may be realized by providing a plasma display panel having a plurality of first electrodes divided by a plurality of groups including first and second groups, a plurality of second electrodes, and a plurality of third electrodes intersecting the plurality of first and second electrodes, a controller configured to divide one frame into a plurality of subfields, each subfield including a reset period, an address period, and a sustain period, and a driver configured to supply a scan pulse and a scan reference voltage to the first and second groups, respectively, and to supply a compensation pulse to at least one the first and second groups during the address period.

The driver may be configured to supply first and second compensation pulses to the first and second groups, respectively.

The driver may include a scan switch circuit unit including first and second scan switches configured to sequentially supply the scan pulse, a first voltage supplier including a first power source configured to supply a first voltage, and a first switch having a first terminal connected to the first power source and a second terminal connected to the scan switch circuit unit, a second voltage supplier including a second power source configured to supply a second voltage higher than the first voltage, and a scan capacitor having a first terminal connected to the second power source and to the first scan switch, and a second terminal connected to the second scan switch, and a third voltage supplier including a third power source configured to supply a third voltage lower than the first voltage, and a second switch having a first terminal connected to the third power supplier and a second terminal connected to the switch circuit unit, wherein the first compensation pulse is supplied to the first group by turning on the first switch and the second scan switch, and the second compensation pulse is supplied to the second group by turning on the first switch and the first scan switch.

The driver may be configured to supply the scan reference voltage by turning on the second switch and the first scan switch, and supply the scan pulse by turning on the second switch and the second scan switch.

The driver may further increase a rising voltage supplier including a fourth power source configured to supply a fourth voltage, and a third switch having a first terminal connected to the fourth power source and a second terminal connected to the scan switch circuit unit, wherein the first compensation pulse is supplied by turning on the first switch, the second scan switch and the third switch, and the second compensation pulse is supplied by turning on the first switch, the first scan switch and the second switch. The rising voltage supplier may include a ramp circuit configured to gradually increase from a starting voltage to a sum of the starting voltage and the fourth voltage.

The driver may be configured to supply the compensation pulse to the first group, the compensation pulse having a voltage sufficient to maintain wall charges in the first group during the second address period. The driver may be configured to supply the compensation pulse to the second group, the compensation pulse having a voltage sufficient to restore wall charges in the second group after the first address period.

BRIEF DESCRIPTION OF THE DRAWINGS

The above and other features and advantages will become more apparent to those of ordinary skill in the art by describing in detail exemplary embodiments thereof with reference to the attached drawings, in which.

DETAILED DESCRIPTION OF THE INVENTION

Figure 1:
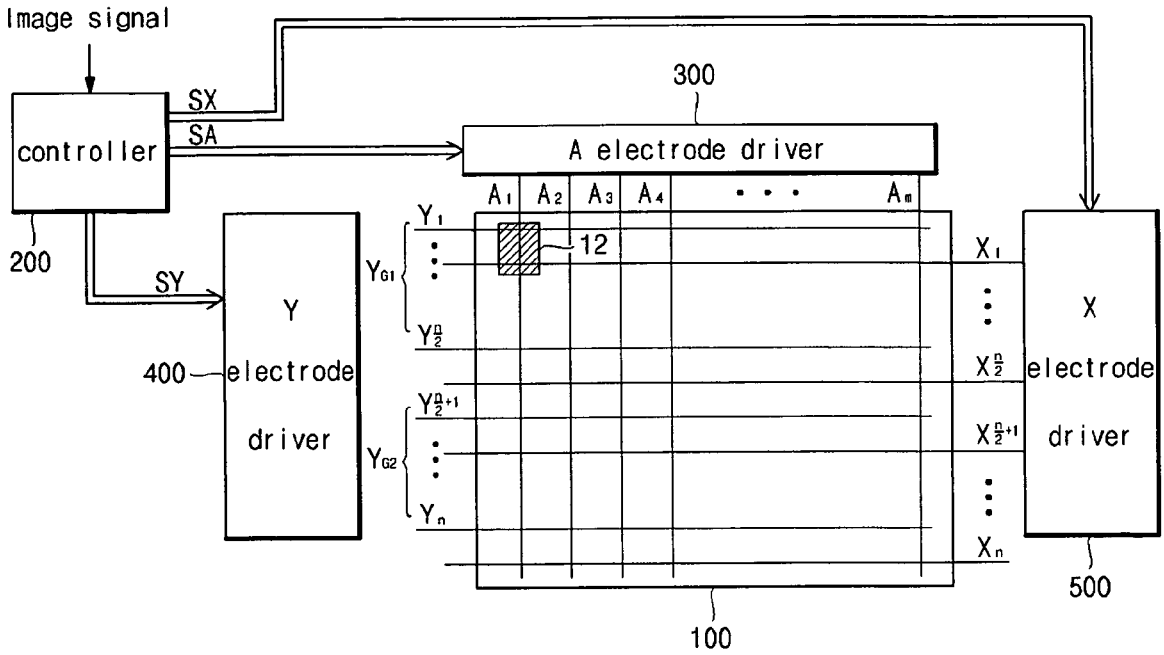
FIG. 1 illustrates a block diagram of a plasma display device according to one exemplary embodiment of the present invention.

Korean Patent Application No. 10-2007-0021765, filed on Mar. 6, 2007, in the Korean Intellectual Property Office, and entitled: "Plasma Display Device and Driving Method Thereof," is incorporated by reference herein in its entirety.

Hereinafter, embodiments will be described in detail with reference to the accompanying drawing figures. The aspects and features, and methods for achieving the aspects and features, will be apparent by referring to the embodiments to be described in detail with reference to the accompanying diagrams. However, the embodiments are not limited to those disclosed hereinafter, but may be implemented in diverse forms. The matters defined in the description, such as the detailed construction and elements, are nothing but specific details provided to assist those of ordinary skill in the art in a comprehensive understanding of the embodiments, which are only defined within the scope of the appended claims.

Throughout the description, the same reference numerals may be used for the same elements across various drawing figures.

As used herein, wall charges refer to charges generated closely to each electrode on the wall of a cell (for example, dielectric layers). Although these wall charges are not actually in contact with the electrode itself, wall charges are indicated as being "generated," "accumulated" or "piled up." Also, wall voltage refers to a potential difference generated on the wall of a discharge cell by wall charges.

First, a plasma display according to an exemplary embodiment of the present invention will be explained.

FIG. 1 illustrates a schematic diagram of a plasma display device according to one exemplary embodiment of the present invention. Referring to FIG. 1, the plasma display device may include a plasma display panel (PDP) 100, a controller 200, a driver 300 adapted to drive A electrodes, a driver 400 adapted to drive Y electrodes, and a driver 500 adapted to drive X electrodes.

The PDP 100 may include a plurality of first electrodes ($Y_1$-$Y_n$), a plurality of second electrodes ($X_1$-$X_n$), and a plurality of third electrodes ($A_1$-$A_n$). The first electrodes ($Y_1$-$Y_n$) may be alternately arranged with the second electrodes ($X_1$-$X_n$), and the third electrodes ($A_1$-$A_n$) may intersect the first electrodes ($Y_1$-$Y_n$) and the second electrodes ($X_1$-$X_n$). A discharge cell 12 of the PDP 100 may be defined where the first electrodes ($Y_1$-$Y_n$), the second electrodes ($X_1$-$X_n$), and the third electrodes ($A_1$-$A_n$) intersect.

The first electrodes ($Y_1$-$Y_n$) may be divided into a plurality of groups including a first group ($Y_{G1}$) and a second group ($Y_{G2}$). The first group ($Y_{G1}$) may include first electrodes ($Y_1$-$Y_{n/2}$) in an upper part of the PDP 100. The second group ($Y_{G2}$) may include first electrodes ($Y_{n/2+1}$-$Y_n$) in a lower part of the PDP 100. However, the division of the first electrodes ($Y_1$-$Y_n$) is not limited thereto. For example, the first group ($Y_{G1}$) may include odd numbered first electrodes, and the second group ($Y_{G2}$) may include even numbered first electrodes. The structure of the PDP 100 according to embodiments is not limited thereto, and embodiments as explained below may also be applied to PDPs having other structures.

The controller 200 may receive an external image signal, generate a plurality of control signals (SY, SX, SA) to drive the first electrodes ($Y_1$-$Y_n$), the second electrodes ($X_1$-$X_n$), and the third electrodes ($A_1$-$A_n$), respectively, and may provide the generated control signals to each driver 300, 400, and 500. The controller 200 may divide one frame into a plurality of subfields having a weight value, and may divide each subfield into a reset period, an address period and a sustain period.

The driver 300 may include a driving circuit configured to receive a address control signal (SA) from the controller 200 and provide a driving waveform to the third electrodes ($A_1$-$A_n$). The driver 400 may include a driving circuit configured to receive a scan control signal (SY) from the controller 200 and provide a driving waveform to the first electrodes ($Y_1$-$Y_n$). The driver 500 may include a driving circuit configured to receive a sustain control signal (SX) from the controller 200 and provide a driving waveform to the second electrodes ($X_1$-$X_n$).

Figure 2:
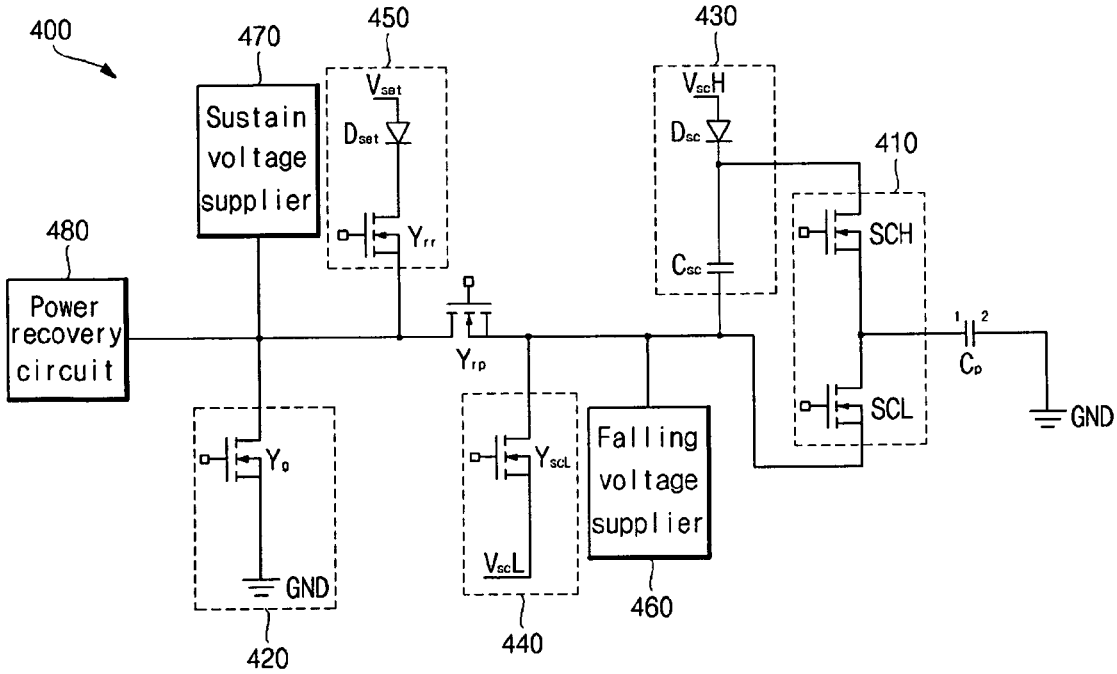
FIG. 2 illustrates a schematic diagram of a driving circuit of the FIG. 1 according to an embodiment.

FIG. 2 illustrates a schematic diagram of the Y electrode driver 400 of the plasma display device according to an embodiment. While the switch elements illustrated in FIG. 2 are n-channel Field Effect Transistors, embodiments are not limited thereto, e.g., other switch elements having identical or similar function may be employed. Further, when any element is connected to another element in this embodiment, these parts may be directly coupled to each other, or may be electrically coupled through other elements.

Referring to FIG. 2, the Y electrode driver 400 may include a scan switch circuit unit 410 configured to sequentially supply a scan pulse to Y electrodes, a ground voltage supplier 420 configured to supply a ground voltage, a scan high-voltage supplier 430 configured to supply a scan high-voltage VscH, a scan low-voltage supplier 440 configured to supply a scan low-voltage VscL, a rising voltage supplier 450 configured to increase a voltage, a falling voltage supplier 460 configured to decrease a voltage, a sustain voltage supplier 470 configured to supply the sustain pulse, and a power recovering circuit 480 configured to recover power consumed during the driving of the plasma display device. In FIG. 2, a panel capacitor Cp represents capacitance generated by the PDP 100 during driving of Y electrodes (the first terminal of the panel capacitor Cp) and X electrodes (the second terminal of the panel capacitor Cp). To more clearly explain embodiments, and as conventional structures may be employed, details of the falling voltage supplier 460, the sustain voltage supplier 470, and the power recovering circuit 480 will not be provided.

The scan switch circuit unit 410 may include first and second scan switches (SCH, SCL) to select the scan pulse applied to Y electrodes at the first terminal of the panel capacitor Cp during the address period. A common node between the first and second scan switches (SCH, SCL) may be connected to Y electrodes through the first terminal of panel capacitor Cp. The ground voltage supplier 420 may include a ground source (GND), and a switch (Yg) having a first terminal connected to the ground source (GND) and a second terminal connected to the scan switch circuit unit 410.

The scan high-voltage supplier 430 may include a high power source (VscH), and a scan capacitor (Csc) having a first terminal connected to the first scan switch (SCH) and a second terminal connected to the second scan switch (SCL) to store the voltage. A diode (Dsc) may be connected between the power source (VscH) and the scan capacitor (Csc) to prevent current from flowing in the opposite direction. The scan low-voltage supplier 440 may include a low power source (VscL), and a switch (YscL) having a first terminal connected to the low power source (VscL) and a second terminal connected to the scan switch circuit unit 410. The scan high-voltage supplier 430 and the scan low-voltage supplier 440 together may supply a scan reference voltage (VscL+VscH) and a scan pulse VscL to Y electrodes during the address period.

The rising voltage supplier 450 may include a power source (Vset), and a switch (Yrr) having a first terminal connected to the power source (Vset) and a second terminal connected to the scan switch circuit unit 410. A diode (Dset) may be connected between the power source (Vset) and the switch (Yrr) to prevent current from flowing in the opposite direction. Although not shown in the drawings, the rising voltage supplier 450 may additionally include a driving circuit to gradually increase the voltage.

A short-circuit preventing switch (Yrp) may be included to prevent the short-circuit current from flowing between the ground voltage supplier 420 and scan low-voltage supplier 440.

Hereafter, a driving method of the plasma display device according to a first exemplary embodiment of the present invention will be explained in detail. To aid the understanding of the embodiments, the first electrodes ($Y_1$-$Y_n$), the second electrodes ($X_1$-$X_n$), and the third electrodes ($A_1$-$A_n$) will be explained as "Y electrodes", "X electrodes" and "A electrodes", respectively.

Figure 3:
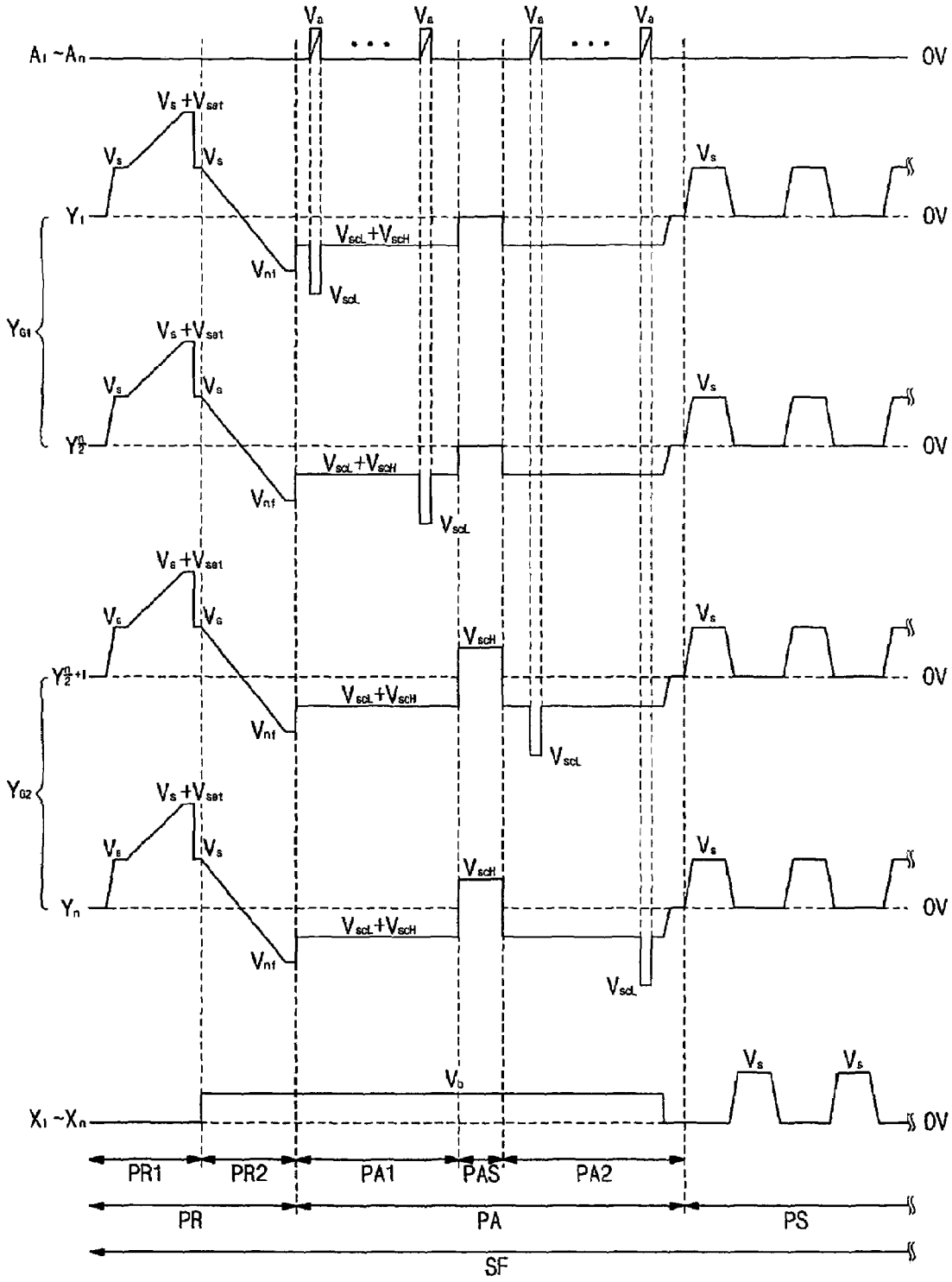
FIG. 3 illustrates a timing diagram of a driving waveform supplied to the plasma display device according to an exemplary embodiment.

FIG. 3 illustrates a driving waveform supplied to the plasma display device by a driving method according to an exemplary embodiment of the present invention. Referring to FIG. 3, the driving method may include dividing one frame into a plurality of subfields, each subfield including a reset period (PR), an address period (PA), and a sustain period (PS). For convenience of explanation, a single subfield will be explained below. However, the driving method of the plasma display device according to the exemplary embodiment of the present invention is not limited to any specific subfield.

The reset period (PR) is a period for rearranging wall charges of the discharge cells, and may include including a reset rising period (PR1) and a reset falling period (PR2). During the reset rising period (PR1), the reset rising pulse may increase from a sustain voltage Vs to the voltage level Vset is supplied to Y electrodes form the rising voltage supplier 450, while X and A electrodes are maintained at a ground voltage. Accordingly, negative wall charges accumulate at Y electrodes as the reset discharge is performed, while positive wall charges accumulate at the X and A electrodes. During the reset falling period (PR2), the pulse may decrease from the sustain voltage Vs to a near-firing voltage Vnf, while the X and A electrodes are maintained at a bias voltage Vb and the ground voltage, respectively. Accordingly, reset discharge is performed in the discharge cells, erasing negative wall charges accumulated at Y electrodes and positive wall charges accumulated at the X and A electrodes. Thus, when the reset period (PR) is complete, wall charges are properly rearranged to allow address discharge to be accurately performed.

Next, the address period (PA) selects on-cells from among the discharge cells. The address period (PA) may include a first address period (PA1), a compensation period (PAS), and a second address period (PA2). During the first address period (PA1), the scan pulse may be sequentially supplied to the first group ($Y_{G1}$). During the compensation address period (PAS), first and second compensation pulses may be supplied to the first and second groups ($Y_{G1}$,$Y_{G2}$), respectively. During the second address period (PA2), scan pulses may be sequentially supplied to the second group ($Y_{G2}$).

In detail, during the first address period (PA1), a scan pulse may be sequentially supplied from the scan low-voltage supplier 420 to the first group ($Y_{G1}$) while X electrodes are kept at the bias voltage Vb and the address voltage Va is supplied to A electrodes. The scan pulse may have a low scan voltage VscL of a negative polarity, and the address pulse may have an address voltage Va voltage of a positive polarity. Accordingly, in selected discharge cells in the first group ($Y_{G1}$), i.e., cells receiving the scan pulse VscL, address discharge is performed by adding the wall voltage due to the wall charges generated at the completion of the reset period (PR) to the electric potential difference (Va−VscL) between the first group ($Y_{G1}$) and the A electrodes. Thus, wall charges for use in realizing the sustain discharge may be generated in the selected discharge cells in the first group ($Y_{G1}$). When the scan pulse is not provided, the scan reference voltage (VscL+VscH) is supplied from the scan high-voltage suppler 430 and the scan low-voltage supplier 420 to the first group ($Y_{G1}$), such that address discharge does not occur.

Similarly, during the second address period (PA2), the scan pulse may be sequentially supplied from the scan low-voltage supplier 420 to the second group ($Y_{G2}$) while X electrodes are kept at the bias voltage Vb and the address voltage Va is supplied to A electrodes. The scan pulse and the address pulse in the second address period (PA2) may have the same voltage level as the scan pulse and the address pulse of the first address period (PA1). Accordingly, at a discharge cell in the second group ($Y_{G2}$), the address discharge is performed by adding the wall voltage due to the wall charges generated at completion of the reset period (PR) to the voltage generated by the second group ($Y_{G2}$) and A electrodes. Thus, wall charges for realizing sustain discharge during the sustain period (PS) may be generated in selected discharge cell in the second group ($Y_{G2}$) by address discharge.

Since address discharge of discharge cells in the first group ($Y_{G1}$) is performed first, followed by address discharge of discharge cells in the second group ($Y_{G2}$), inaccurate address discharge may be performed in the second group ($Y_{G2}$). For example, during address discharge in discharge cells in the second group ($Y_{G2}$), wall charge states may vary and decrease compared with a wall charge state immediately after completion of the reset period (PR), since time for the first address period (PA1) has passed.

To reduce or prevent the above problem, the first compensation pulse and the second compensation pulse may be simultaneously supplied to the first group ($Y_{G1}$) and the second group ($Y_{G2}$), respectively, during the address compensation period (PAS) to compensate for altered wall charges. Thus, wall charges of the discharge cells in the second group ($Y_{G2}$) may be provided at the same state as that at the completion of the reset period (PR) due to the second compensation pulse, thereby allowing the address discharge to be correctly performed. The discharge cells in the first group ($Y_{G1}$) may maintain a stable wall charge state during the second address period (PA2) due to the first compensation pulse.

While both the first compensation pulse and the second compensation pulse are simultaneously supplied to the first group ($Y_{G1}$) and the second group ($Y_{G2}$), respectively, in FIG. 3, embodiments are not limited thereto. For example, the first compensation pulse may be sequentially supplied to the first group ($Y_{G1}$) after the scan pulse is provided. The second compensation pulse may be sequentially supplied to the second group ($Y_{G2}$) before the scan pulse is provided.

The first compensation pulse may have a suitable voltage level to maintain a stable wall charge state of the discharge cells in the first group ($Y_{G1}$) during the second address period (PA2). Thus, the first compensation pulse may have a higher voltage level than the scan reference voltage (VscL+VscH). However, more wall charges may be produced than required when the voltage level of the first compensation pulse is higher than the sustain voltage (Vs), which may result in a mis-discharge during the address period (PA). Therefore, the first compensation pulse may have a voltage higher than the scan reference voltage (VscL+VscH) but lower than the sustain voltage Vs. For example, as illustrated in FIG. 3, the first compensation pulse may have the ground voltage level GND, but is not limited thereto.

The second compensation pulse may have a suitable voltage level to keep the same wall charge state as that at completion of the reset period (PR) in order to perform accurate address discharge in the discharge cells in the second group ($Y_{G2}$). Thus, the second compensation pulse may have a higher voltage level than the scan reference voltage (VscL+VscH). For example, as illustrated in FIG. 3, the second compensation pulse may have the high voltage (VscH). Alternatively, the second compensation pulse may have the same voltage, e.g., the ground voltage, as the first compensation pulse. Additionally, the voltage level of the second compensation pulse may compensate for the loss of wall charges before address discharge, but is not limited thereto.

The first compensation pulse and the second compensation pulse may be supplied to each Y electrode within the group at the same voltage level in accordance with embodiments. However, the first compensation pulse and the second compensation pulse may supply a different voltage level stepwise to each Y electrode, or subset thereof, with in the Y electrode groups. For example, the voltage level of the first compensation pulse supplied to the first Y electrode in the first group ($Y_{G1}$) may be highest, and maybe sequentially decreased, e.g., stepwise, to last Y electrode in the first group ($Y_{G1}$). Also, the voltage level supplied to the first Y electrode in the second group ($Y_{G2}$) may be lowest, and may be sequentially increased, e.g., stepwise, to the last Y electrode in the first group ($Y_{G2}$). Thus, each group may compensate for changes in wall charge states due to time differences in relative address discharge timing by controlling the voltage level.

During the sustain period (PS), the sustain pulse having the sustain voltage Vs is supplied to Y and X electrodes, and the ground voltage is supplied to A electrodes. The number of the sustain pulses may be determined in proportion to gray level weight of the corresponding subfield (SF). Accordingly, the sustain discharge is performed due to the voltage difference (Vs) between Y and X electrodes, and the wall voltage resulting from wall charges generated in the address period (PA), so that the image is displayed on the PDP 100.

Figure 4A:
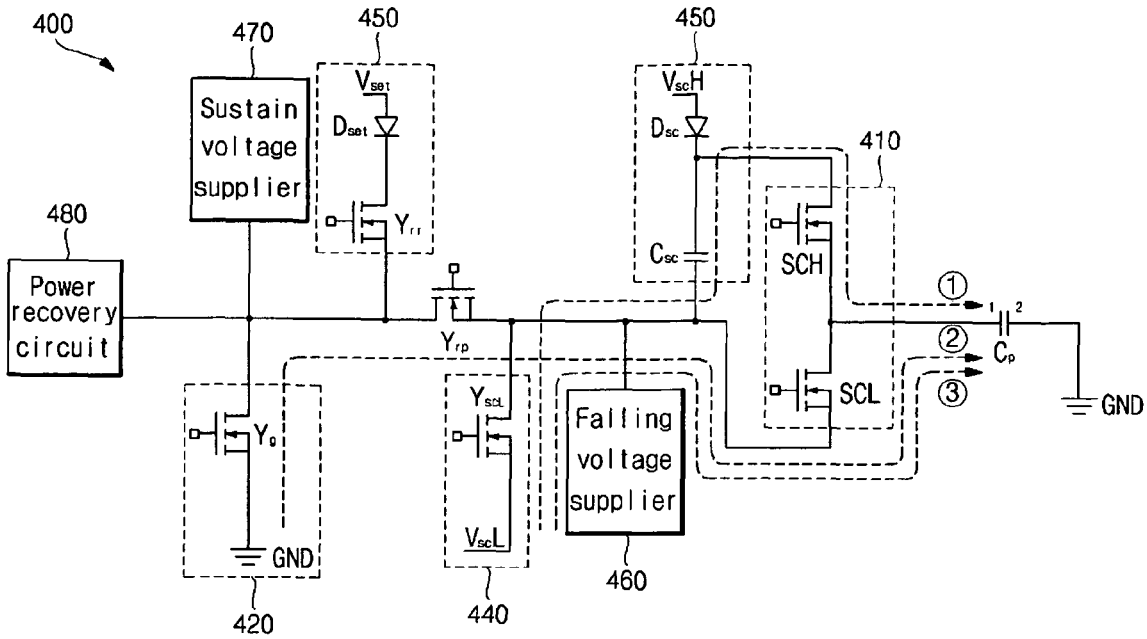
FIGS. 4A and 4B illustrate schematic diagrams of an electrical path of a driving waveform in the driving circuit of FIG. 2 when driven using the driving waveform of FIG. 3 according to an exemplary embodiment.
Figure 4B:
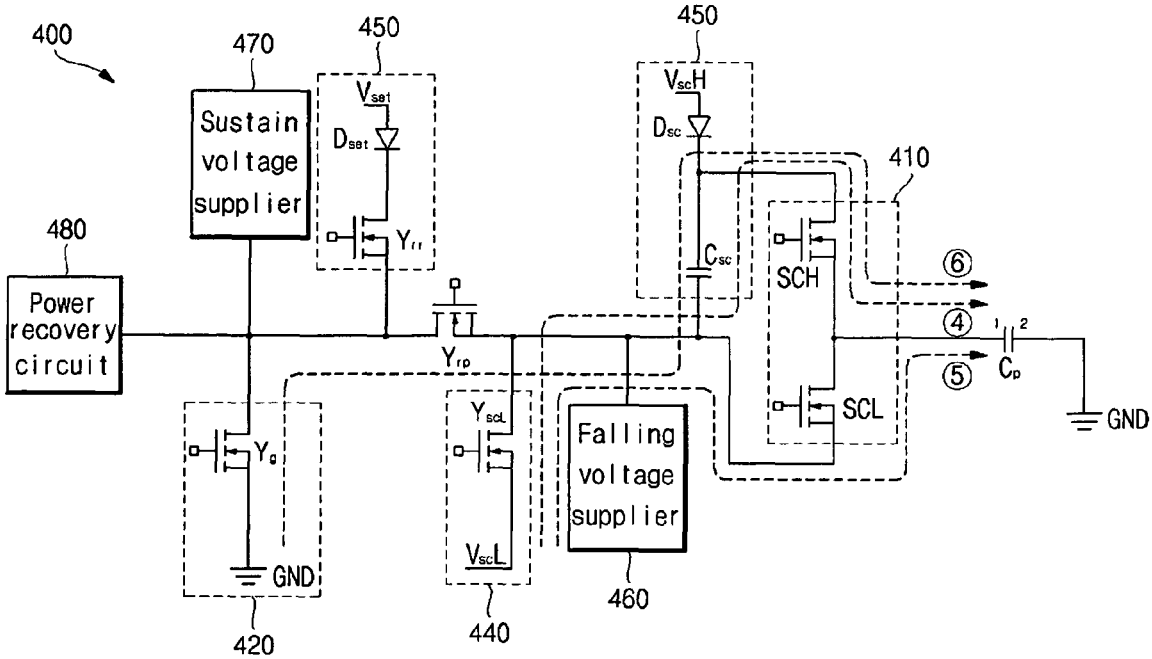

FIGS. 4A and 4B illustrate supply paths of a driving waveform supplied by the Y electrode driver of FIG. 2 during the address period (PA) in accordance with the timing diagrams of FIG. 3. FIG. 4A illustrates a supply path of the driving waveform to the first group ($Y_{G1}$), and FIG. 4B illustrates a supply path of the driving waveform to the second group ($Y_{G2}$).

Referring to FIGS. 4A and 4B, the supply path of the driving waveform during the address period (PA) according to an exemplary embodiment may include a first path ① and a second path ② that supply the scan reference voltage (VscL+VscH) and the scan pulse to the first group ($Y_{G1}$) to perform address discharge in selected discharge cells in first group ($Y_{G1}$), a third path ③ that supplies the first compensation pulse to the first group ($Y_{G1}$), a fourth path ④ and a fifth path ⑤ that supply the scan reference voltage (VscL+VscH) and the scan pulse to the second group ($Y_{G2}$) to perform address discharge in selected discharge cells in the second group ($Y_{G2}$), and a sixth path ⑥ that supplies the second compensation pulse.

The first path ① supplies the scan reference voltage (VscL+VscH) to the first group ($Y_{G1}$). To form the first path ①, the switch (YscL) of the scan low-voltage supplier 440 and the first scan switch (SCH) are turned on. Accordingly, the voltage VscL is charged across the scan capacitor Csc, and the scan reference voltage (VscL+VscH) is supplied to the first group ($Y_{G1}$) through the first path ①.

The second path ② supplies the scan pulse to the discharge cell containing the first group ($Y_{G1}$) to generate address discharge. To form the second path ②, the switch (YscL) of the scan low-voltage supplier 440 and the second scan switch (SCL) are turned on. Thus, the scan pulse having VscL voltage is supplied to the first group ($Y_{G1}$) through the second path ②.

The third path ③ supplies the first compensation pulse to the first group ($Y_{G1}$). To form the third path ③, the switch (Yg) of the ground voltage supplier 420, the short-circuit preventing switch (Yrp) and the second scan switch (SCL) are turned on. Thus, the first compensation pulse having the ground voltage is supplied to the first group ($Y_{G1}$) through the third path ③.

The fourth path ④ supplies the scan reference voltage (VscL+VscH) to the second group ($Y_{G2}$). The fourth path ④ is formed in the same manner as the first path ① that supplies the scan reference voltage (VscL+VscH) to the first group ($Y_{G1}$).

The fifth path ⑤ supplies the scan pulse to the discharge cell containing the second group ($Y_{G2}$) to generate the address discharge. The fifth path ⑤ is formed in the same manner as the second path ② that supplies the scan pulse to the first group ($Y_{G1}$).

The sixth path ⑥ supplies the second compensation pulse to the second group ($Y_{G2}$). To form the sixth path ⑥, the switch (Yg) of the ground voltage supplier 420, the short-circuit preventing switch (Yrp), and the first scan switch (SCH) are turned on. Accordingly, VscH voltage is charged across the scan capacitor (Csc). Thus, the second compensation pulse, which may be up to as much as VscH voltage above the ground voltage, is supplied to the second group ($Y_{G2}$) through the sixth path ⑥.

Figure 5:
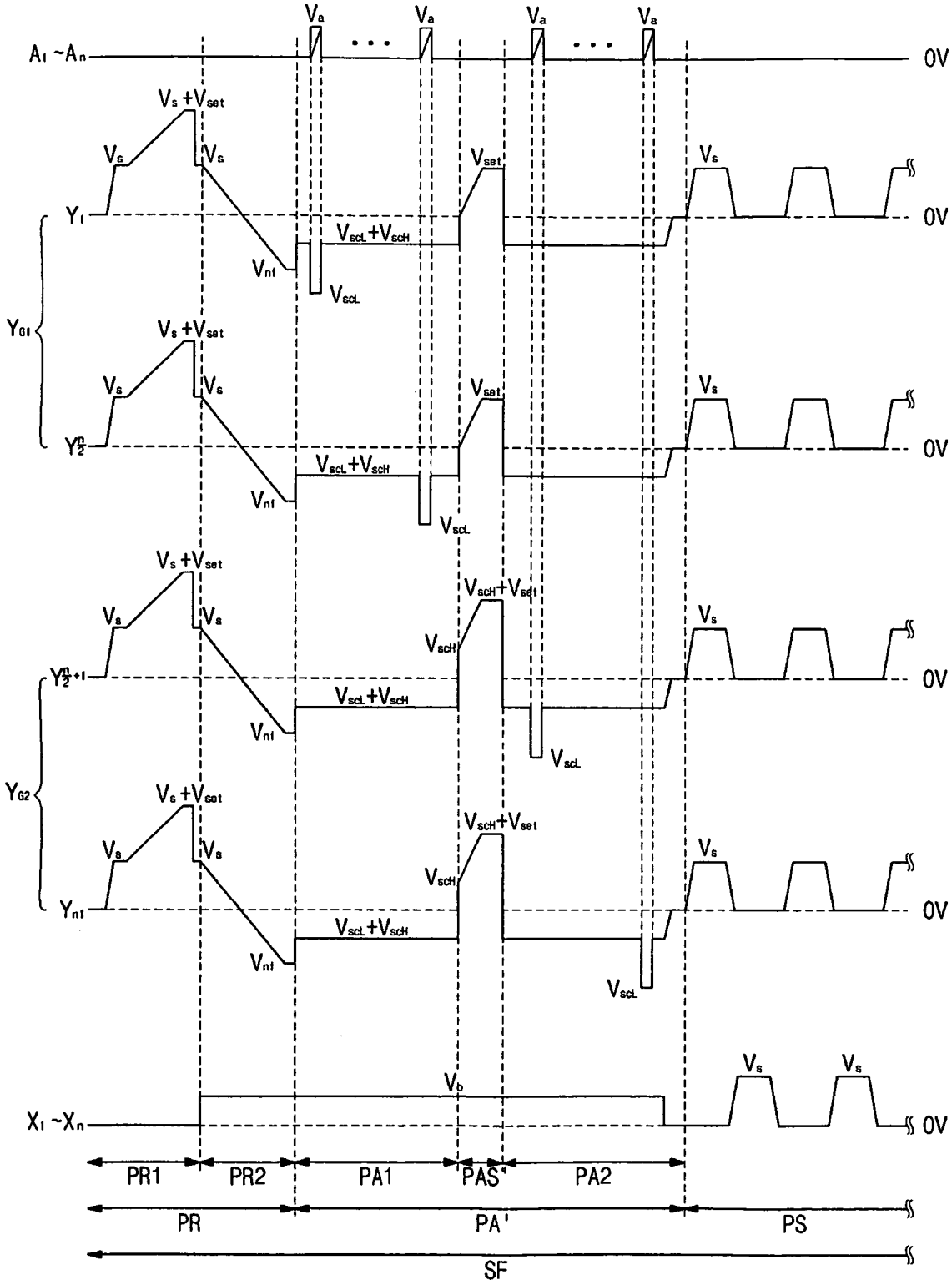
FIG. 5 illustrates a timing diagram of a driving waveform supplied to the plasma display device according to another exemplary embodiment of the present invention.

FIG. 5 illustrates a driving waveform supplied to the plasma display device by a driving method thereof according to another exemplary embodiment of the present invention. Aspects of the driving method of the plasma display device according to the another exemplary embodiment of the present invention that are the same or similar constitution as the first exemplary embodiment of FIG. 3 will not be repeated. Thus, only differences between the different exemplary embodiments will be explained in detail below.

Referring to FIG. 5, an address period (PA') may include the first address period (PA1), an address compensation period (PAS'), and the second address period (PA2). The address compensation period (PAS') may include first and second compensation pulses supplied to the first ($Y_{G1}$) group and the second group ($Y_{G2}$), respectively, that do not have a square pulse. For example, the address compensation period (PAS') may be an address ramping compensation period (PAS'), and may supply first and second ramping compensation pulses.

During the address ramping compensation period (PAS'), first and second ramping compensation pulses may be supplied to the first ($Y_{G1}$) group and the second group ($Y_{G2}$), respectively. The first ramping compensation pulse may have a voltage increasing from the ground voltage up to the Vset voltage. The second ramping compensation pulse may have a voltage increasing from a voltage VscH by up to the voltage Vset, i.e., (VscH+Vset).

In the exemplary embodiment of FIG. 5, the first and second ramping compensation pulses may be simultaneously or sequentially supplied to the first ($Y_{G1}$) group and the second group ($Y_{G2}$), respectively. Thus, according to this exemplary embodiment, supply of the first and second ramping compensation pulses to the first ($Y_{G1}$) group and the second group ($Y_{G2}$), respectively, allow wall charges lost after the address discharge to be compensated more stably. The first and second ramp compensation pulses may supply a sufficient high voltage level without unnecessary discharge during the address period (PA), as compared with the square pulse used in FIG. 3. Also, if necessary, a voltage rising time and a rising level of the first and second ramping compensation pulses may be controlled, but not limited thereto. The basic effect of the driving method according to the second exemplary embodiment of the present invention is the same as that of the first exemplary embodiment of the present invention.

Figure 6A:
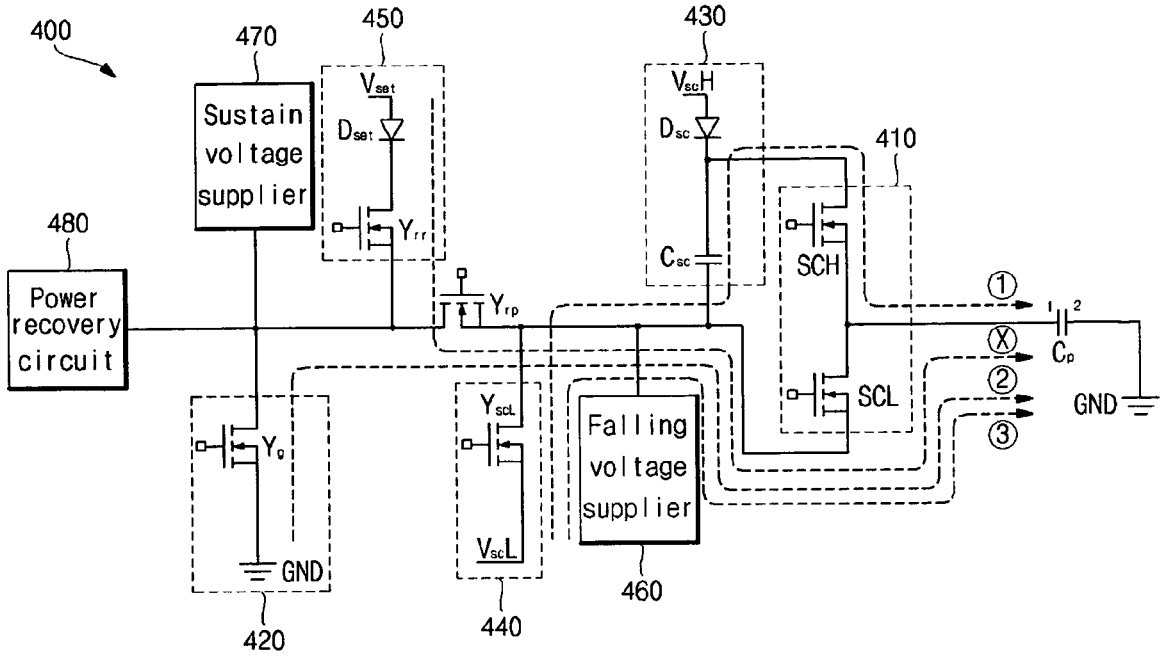
FIGS. 6A and 6B illustrate schematic diagrams of an electrical path of a driving waveform in the driving circuit of FIG. 2 when driven using the driving waveform of FIG. 5 according to an exemplary embodiment.
Figure 6B:
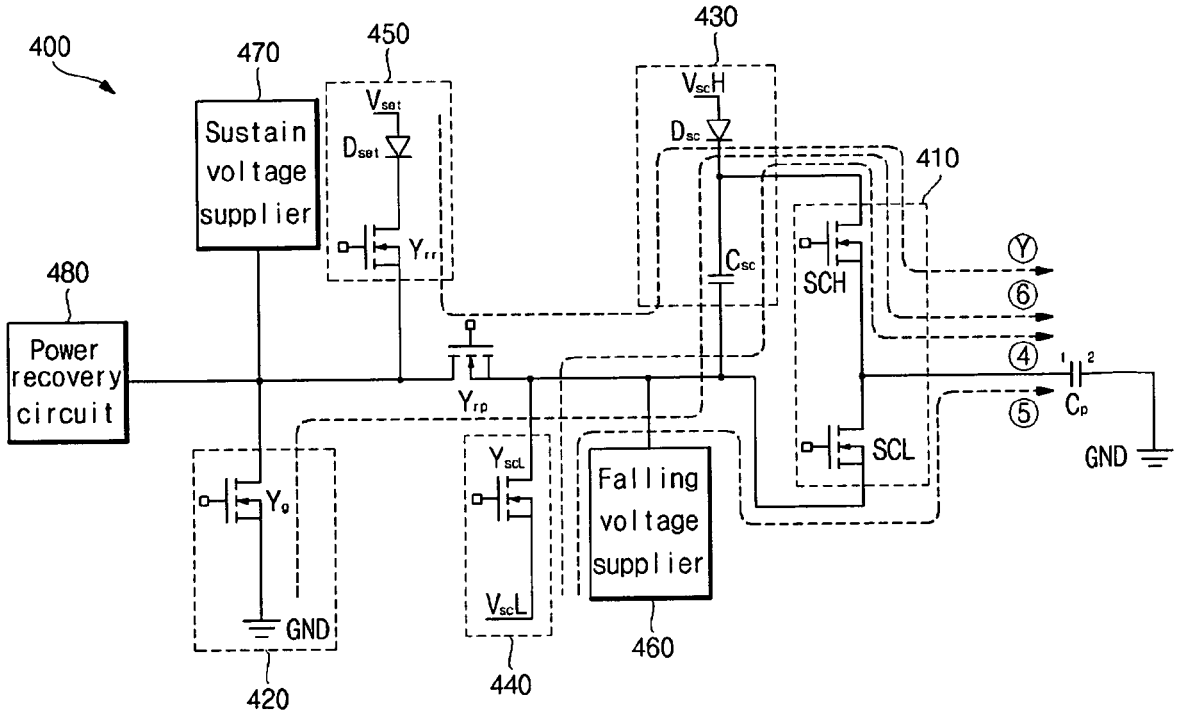

FIGS. 6A and 6B illustrate supply paths of a driving waveform supplied to the driving circuit of FIG. 2 according to the address period (PA') in FIG. 5. FIG. 6A illustrates a supply path of a driving waveform supplied to the first group ($Y_{G1}$), and FIG. 6B illustrates a supply path of a driving waveform supplied to the second group ($Y_{G2}$). The supply paths of this embodiment also include a supply path for the first and second ramping compensation pulses. The same diagram code is used for the same paths in FIGS. 4A, 4B, 6A and 6B.

Referring to FIGS. 6A and 6B, the supply path of the driving waveform according to one exemplary embodiment includes the first path ① and the second path ② that supply the scan reference voltage (VscL+VscH) and the scan pulse to the first group ($Y_{G1}$), the third path ③ and an X path (X) that supply the first ramp compensation pulse, the fourth path ④ and the fifth path ⑤ that supply the scan reference voltage (VscL+VscH) and the scan pulse to the discharge cell containing the second group ($Y_{G2}$), and the sixth path ⑥ and a Y path (Y) that supply the second ramping compensation pulse. The first path ① to the sixth path ⑥, i.e., supply paths other than the X path or the Y path, are realized in the same manner as described above in connection with FIGS. 4A and 4B, and will not be repeated.

The X path (X) supplies the first ramping compensation pulse to the first group ($Y_{G1}$). The X path (X) is formed by turning-on the switch (Yrr) of the rising voltage supplier 450 while the ground voltage is supplied through the third path ③. Accordingly, the first ramping compensation pulse rising from the ground voltage to the voltage Vset is supplied to the first group ($Y_{G1}$) through the third path ③ and the X path (X).

The Y path (Y) supplies the second compensation pulse having the rising voltage of a lamp type to the second group ($Y_{62}$). The Y path (Y) is formed by turning-on the switch (Yrr) of rising voltage supplier 450 while the voltage VscH is supplied through the sixth path ⑥. Accordingly, the second ramping compensation pulse rising from VscH voltage to Vset voltage, i.e., VscH+Vset, is supplied to the second group ($Y_{G2}$) through the sixth path ⑥ and the Y path (Y).

As described above, first and second compensation pulses may be supplied to the first group ($Y_{G1}$) and the second group ($Y_{G2}$), respectively, using the same driving circuit, i.e., without the need to use different driving circuits, according exemplary embodiments of the present invention. Therefore, separate driving circuits for each group of Y electrodes divided into a plurality of groups are not needed. Embodiments may also further eliminate the need for additional power source(s) and/or circuit element(s) to supply the first and second compensation pulses.

Although the Y electrodes are explained as being divided into two groups in embodiments, the Y electrodes may be divided into more than two groups and still employ the driving method of embodiments. According to embodiments described above, compensation pulses may be supplied to each group during the address period between driving of respective groups.

As described above, the plasma display device and driving method according to embodiments may realize the following effects.

First, during the address period, a compensation pulse may be supplied to a group to be subsequently addressed to maintain adequate wall charges to reduce or prevent address discharge from occurring at a low discharge. Second, during the address period, a compensation pulse may be supplied to a previously addressed group to maintain adequate wall charges for sustain discharge. Third, additional driving circuits may not be needed to supply driving waveforms to each group, since the same driving circuit may be used to supply driving waveforms to the plurality of Y electrode groups.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A plasma display device, comprising:

a plasma display panel having a plurality of first electrodes divided into a plurality of groups including first and second groups, a plurality of second electrodes, and a plurality of third electrodes intersecting the plurality of first and second electrodes;

a controller configured to divide one frame into a plurality of subfields, each subfield including a reset period, an address period, and a sustain period; and a driver configured to supply a scan pulse and a scan reference voltage to the first and second groups, respectively, and to supply a compensation pulse to at least one of the first and second groups during the address period, the driver being configured to supply first and second compensation pulses to the first and second groups, respectively, wherein the driver includes:

a scan switch circuit unit including first and second scan switches configured to sequentially supply the scan pulse;

a first voltage supplier including a first power source configured to supply a first voltage, and a first switch having a first terminal connected to the first power source and a second terminal connected to the scan switch circuit unit;

a second voltage supplier including a second power source configured to supply a second voltage higher than the first voltage, and a scan capacitor having a first terminal connected to the second power source and to the first scan switch, and a second terminal connected to the second scan switch; and a third voltage supplier including a third power source configured to supply a third voltage lower than the first voltage, and a second switch having a first terminal connected to the third power source and a second terminal connected to the switch circuit unit, wherein the first compensation pulse is supplied to the first group by turning on the first switch and the second scan switch, and the second compensation pulse is supplied to the second group by turning on the first switch and the first scan switch.

2. The plasma display device as claimed in claim 1, wherein the driver is configured to:

supply the scan reference voltage by turning on the second switch and the first scan switch; and supply the scan pulse by turning on the second switch and the second scan switch.

3. The plasma display device as claimed in claim 1, wherein the driver further includes:

a rising voltage supplier including a fourth power source configured to supply a fourth voltage, and a third switch having a first terminal connected to the fourth power source and a second terminal connected to the scan switch circuit unit, wherein the first compensation pulse is supplied by turning on the first switch, the second scan switch and the third switch, and the second compensation pulse is supplied by turning on the first switch, the first scan switch and the second switch.

4. The plasma display device as claimed in claim 3, wherein the rising voltage supplier further includes a ramp circuit configured to gradually increase from a starting voltage to a sum of the starting voltage and the fourth voltage.

* * * * *